United States Patent [19]

Grahl et al.

[11] 3,937,029

[45] Feb. 10, 1976

[54] METHOD AND APPARATUS FOR CHARGING AIR CONDITIONERS WITH REFRIGERANT FLUID

[75] Inventors: Darwin R. Grahl; Gary L. Garcia, both of Newark, N.Y.

[73] Assignee: Parker-Hannifin Corporation, Cleveland, Ohio

[22] Filed: Aug. 28, 1974

[21] Appl. No.: 501,222

[52] U.S. Cl. ..... 62/77; 62/511; 236/92 B

[51] Int. Cl.² ..... F25B 45/00

[58] Field of Search ..... 62/77, 292, 511, 174; 236/92 B

[56] References Cited

UNITED STATES PATENTS

| | | | |
|---|---|---|---|
| 2,950,608 | 8/1960 | Abbott | 62/511 |
| 3,303,663 | 2/1967 | Miller et al. | 62/149 |
| 3,311,131 | 3/1967 | Zahuranec | 62/511 X |
| 3,813,893 | 6/1974 | Gemender | 62/149 X |

*Primary Examiner*—William E. Wayner
*Attorney, Agent, or Firm*—John N. Wolfram

[57] ABSTRACT

A refrigerant fluid charging device that comprises an expansion valve, a charging tube for connecting the outlet of the expansion valve to the system to be charged, a thermally conductive tube enveloping the charging tube, and a thermal sensing tube connected to the expansion valve, the sensing tube being in temperature sensing contact with the conductive tube at spaced locations and at one of such locations being adapted to be brought into temperature sensing contact with the suction line of the system to be charged. The method includes the steps of providing a charging device in accordance with the foregoing, connecting the inlet of the expansion valve with a source of refrigerant fluid, connecting the charging tube to the suction line of the system to be charged, bringing the thermal sensing tube at one location thereof into temperature sensing contact with the system suction line, and initiating flow of refrigerant fluid from the source of supply through the expansion valve and charging line to the system suction line, and permitting flow of fluid into the system until the expansion valve is automatically closed under the influence of the sensing tube.

14 Claims, 3 Drawing Figures

METHOD AND APPARATUS FOR CHARGING AIR CONDITIONERS WITH REFRIGERANT FLUID

BACKGROUND OF THE INVENTION

Air conditioning and other refrigeration systems require an initial refrigerant fluid charge and may also require occasional replenishment or replacement of this fluid. To either initially charge or refill the system in the field requires special equipment and techniques and heretofore it has been difficult to accomplish in a relatively short time and with good control against overfilling.

SUMMARY OF THE INVENTION

The present invention provides a charging device that includes an expansion valve connectable to a source of refrigerant fluid and which has a charging tube at its outlet which is connectable to an access port of the system in the suction line for the compressor. A thermally conductive tube surrounds and protects the charging tube against mechanical damage to the charging tube during handling of the device and also provides good thermal flow capability that is utilized in the operation of the device.

The device also includes a thermal sensing tube connected to the power element of the expansion valve and which is in temperature sensing contact with the conductive tube at two locations. At one of the locations the sensing tube senses temperature of the conducting tube at that point. At the other location the sensing tube is adapted to be also brought into contact with the suction line of the air conditioning system whereby the sensing tube senses a temperature that is a composite of the temperature of the conductive tube at that particular location and the temperature of the system suction line.

The method of the present invention involves connecting of the charging device to a source of refrigerant fluid and to the suction line of the system.

The charging tube is of relatively low flow capacity so that the system cannot be charged too rapidly so as to cause overfilling of the same. The sensing tube directly senses the temperature of the suction line and indirectly senses the temperature of the charging fluid by conduction through the conductive tube. The sensing tube in turn controls opening and closing of the expansion valve in response to the temperatures sensed so as to provide a flow rate that is substantially a maximum for the particular condition of the system for minimizing the time for filling but yet accomplishes rapid and positive shut-off when the proper amount of charge has been introduced into the system.

DETAIL DESCRIPTION

Figure 1:
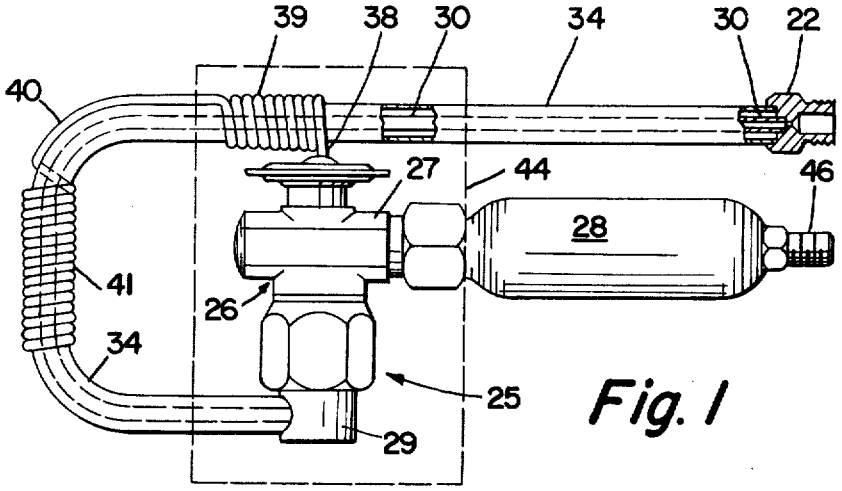
FIG. 1 is a planned view of the charging device.
Figure 2:
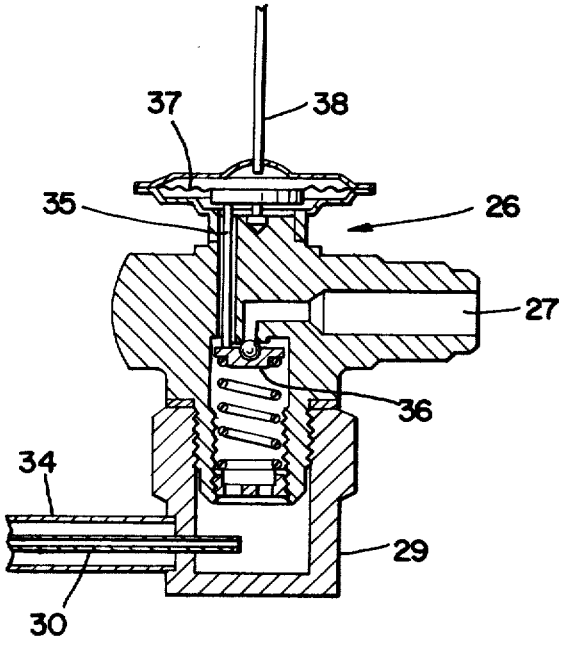
FIG. 2 is a cross section, partially schematic, of a thermo expansion valve used in the charging device.

As shown in the drawing, and as is well known, an air conditioning system will include an evaporator 10 whose outlet side is connected to the inlet of a compressor 11 by a suction line 12. Connected to the suction line is a normally closed valve 13 that can be opened when it is desired to introduce refrigerant fluid into the air conditioning system.

Connectable to valve 13 is a hose assembly 14 that includes a hose 15 with a manifold 16 at one end and a fitting 17 at the other end. The manifold may have a gauge connection 18 and a vent valve 19 which may be in the form of a Schrader type tire valve. Connectable to hose assembly 14 by means of a fitting 22 is the charging device 25 of the present invention.

The charging device includes an expansion valve 26 to whose inlet port 27 a filter drier 28 may be attached and to whose outlet fitting 29 one end of a charging tube 30 is rigidly attached in sealed relation thereto, as by brazing. The other end of the charging tube is rigidly attached to fitting 22 and sealed relative thereto, as by brazing.

A conductive tube 34 is also rigidly attached to expansion valve outlet fitting 29 and to fitting 22 as by brazing and surrounds and has its inside wall spaced from charging tube 30.

The expansion valve 26 has a valve element 36 for controlling flow therethrough and which is mechanically connected by a pin 35 to a diaphragm 37 whose outer margin is attached and sealed to the expansion valve body. One side of diaphragm 37 is exposed to pressure of fluid on the outlet side of valve element 36 via a clearance around pin 35 and the other side is exposed to pressure of fluid in a thermo sensing tube 38 whose one end is connected to valve 26 above diaphragm 37 and whose other end is closed.

Sensing tube 38 has a first coiled portion 39 that is coiled at a first location about conductive tube 34 into tight contact therewith for good heat exchange therebetween and is connected by an uncoiled portion 40 to a second coiled portion 41 that is coiled about conductive tube 34 at a second location and which is also in good heat exchange contact therewith. An insulating block 44 of polystyrene foam or other suitable insulating material encapsulates expansion valve 26 and the first coiled portion 39 of the sensing tube to insulate the same from ambient temperature.

Filter drier 28 has an inlet fitting 46 for connection to a line 47 leading from a valve 48 connected to a tank 49 that contains a supply of refrigerant fluid.

In a preferred embodiment of the device, charging tube 30 is of copper with an outside diameter of about 0.100 inch and an inside diameter of 0.049 inch and with the conductive tube being of copper and having an outside diameter of about 5/16 inch and an inside diameter of about ¼ inch. In other cases the charging tube may have an outside diameter of about 0.100 inch and an inside diameter of from 0.35 inch to 0.065 inch. The sensing tube may be in accordance with usual industry practice in which it is of copper with an outside diameter of about 3/32 inch and having a wall thickness of about 0.030 inch.

OPERATION

Figure 3:
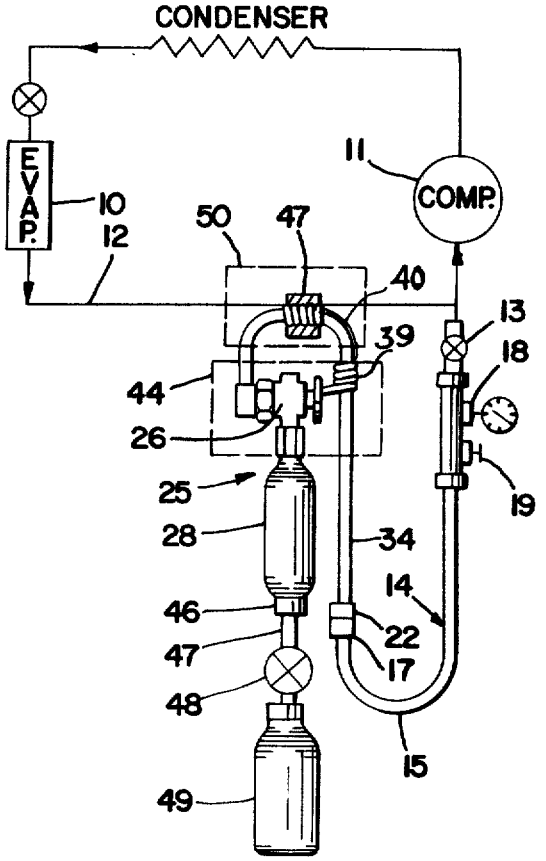
FIG. 3 is a schematic of an air conditioning circuit with the charging device connected thereto.

In use, the charging device 25 is connected to the supply tank and to hose assembly 14 and the latter is connected at manifold 16 to the valve 13 of the air conditioning system, all as shown in FIG. 3. Sensing tube coil portion 41 is then taped or strapped as at 47 into tight engagement with suction line 12 and covered with an insulating material such as foam rubber, as diagramatically illustrated at 50 in FIG. 3, to insulate coil portion 41 from ambient temperature.

To operate the device, as when replenishing an air conditioning system that is low on refrigerant fluid, the air conditioning system is turned on for operating in its normal manner. After the system pressures have stabilized, valve 48 is then opened to initiate flow of refrigerant fluid from tank 49 to the charging device. Valve 19 is then manually opened to purge to atmosphere any air that had been contained in the lines between supply tank 49 and manifold 16.

Following purging, valve 19 is closed and valve 13 is manually opened to permit flow of refrigerant fluid into the system. At this time, because of the depleted supply of refrigerant fluid in the system, suction line 12 will have a temperature higher than its normal operating temperature. Thus, its temperature may be for example, about 60°F. Also at this time, the temperature of the charging tube 30 and of sensing tube 38 and conductive tube 34 may be the same as ambient, as for example 75°F.

At the beginning of the filling operation, valve element 36 of the expansion valve will be fully opened and refrigerant fluid from tank 49 will flow at a fairly rapid rate to filter drier 28, expansion valve 26 and charging tube 30 through hose assembly 14 and valve 13 into suction line 12. The refrigerant fluid is liquid as it passes through expansion valve 26 and charging tube 30 but it vaporizes as it flashes from charging tube 30 into fitting 22 and hose assembly 14. Vaporization in this manner decreases the temperature of the fluid and of outlet fitting 22. The decrease of temperature is transmitted along conductive tube 34 so that the latter will be colder in the vicinity of sensing tube coil 39 than in the vicinity of coil 41. There is also a gradual decrease in the temperature of suction line 12 as the amount of fluid within the air conditioning system increases.

As the temperature of conductive tube 34 and suction line 12 decreases, the changes are detected by both coils 39 and 41, causing a decrease of temperature and thus of the pressure of the motive fluid within sensing tube 38 and on the upper side of diaphragm 37, thus causing a gradual closing movement of valve poppet 36. When the air conditioning system has been filled the proper amount, the temperature of the suction line 12 and conductive tube 34 at coil 41 is such that complete closure of the expansion valve is effected. As for example, the temperature of suction line 12 may be 45°F and that of coil 41 may be 45°F at the time the expansion valve closes. Valves 48 and 13 may then be turned off and the charging device disconnected from the air conditioning system.

To operate the device for charging an air conditioning system containing no refrigerant fluid, the system is first evacuated of air in a conventional manner. The charging device is then connected to the system and to the supply tank 49 and the device and hose assembly 14 are purged of air in the manner already indicated. Thereafter, valve 13 is opened and refrigerant fluid will flow into suction line 12 until the vapor pressure therein increases to some positive pressure, say between 20 and 70 PSI. Compressor 11 is then turned on to operate the system. Fluid from supply tank 49 will then again begin to flow into the system and will continue until the temperature at coils 49 and 41 has reached the proper value for closing of the expansion valve, as aforesaid.

In a modified form of the invention the sensing tube may have only one coil 41 with the first coil 39 omitted.

We claim:

1. A charging device for filling a receiving device with refrigerant fluid, said charging device comprising an expansion valve having an inlet to which a supply of refrigerant fluid may be connected, an outlet, a valve element for controlling flow of refrigerant fluid from said inlet to said outlet, and a pressure sensitive element controlling opening and closing of said valve element, one side of said pressure sensitive element being exposed to pressure of fluid in said outlet, the other side being exposed to fluid in a sensing tube, a charging tube having one end connected to said outlet, the other end of the charging tube having means for connection to the receiving device, said sensing tube being in temperature sensing relation to said charging tube for sensing the temperature thereof, and fluid in said sensing tube responsive to temperature changes in said sensing tube for actuating said pressure sensitive element for opening and closing said valve, and said sensing tube having a portion thereof exposed for contact with a portion of the receiving device.

2. The device of claim 1 in which there is a thermally conductive tube surrounding the charging tube and said sensing tube contacts said conductive tube.

3. The device of claim 2 in which said sensing tube contacts the conductive tube at first and second spaced locations, said first location is adjacent said pressure sensitive element and the second location is between the first location and said outlet.

4. The device of claim 2 in which said sensing tube is coiled about and in temperature sensing contact with said conductive tube.

5. The device of claim 2 in which said sensing tube is coiled about said conductive tube at both said locations.

6. The device of claim 1 in which there is a filter drier unit connected to said inlet and through which refrigerant fluid must pass to enter said inlet.

7. The device of claim 2 in which the other end of said charging tube connects to a fitting that has means for connection to said receiving device and said conductive tube extends from said outlet to said fitting.

8. The device of claim 2 in which said charging tube has an outside diameter of approximately 0.100 inch and an inside diameter of about 0.049 inch, and said conductive tube has an inside diameter of approximately ¼ inch.

9. The device of claim 2 in which said charging and conductive tubes each have a U bend and said second location is at the bottom of the U.

10. The device of claim 2 in which said charging tube has an inside diameter of from about 0.035 inch to 0.065 inch and the inside diameter of said conductive tube is spaced from the outside diameter of the charging tube.

11. The device of claim 7 in which said conductive tube is rigidly connected to both the expansion valve and said fitting.

12. The device of claim 11 in which said charging tube is rigidly connected to both said expansion valve and said fitting and has its exterior sealed relative to each.

13. A method of filling a receiver device with refrigerant fluid by use of a charging device wherein said charging device includes an expansion valve with an inlet and an outlet and a valve element for controlling flow of fluid from said inlet to said outlet, a charging tube connected at one end to said outlet, a pressure sensitive element controlling the valve element, and a temperature sensing tube containing fluid for actuating the pressure sensitive element, said sensing tube being in temperature sensing relation with the charging tube and having a portion thereof exposed, said method comprising connecting said other end of the charging tube to said receiving device, bringing said exposed portion of said sensing tube into contact with a portion of said receiver device, connecting the expansion valve inlet with a source of refrigerant fluid, and connecting the charging tube to said receiving device whereby there will be flow of refrigerant fluid from said source through said charging device to said receiving device until a drop in temperature of the fluid in the sensing line causes automatic closing of said valve element.

14. The method of claim 13 in which a conductive tube surrounds said charging tube and said sensing tube contacts said conductive tube.

* * * * *